US005437228A

United States Patent [19]

Uland

[11] Patent Number: 5,437,228

[45] Date of Patent: Aug. 1, 1995

[54] METHOD AND APPARATUS FOR PRINTING ADHESIVE BACKED MEDIA

[75] Inventor: David M. Uland, Huntersville, N.C.

[73] Assignee: Datasouth Computer Corporation, Charlotte, N.C.

[21] Appl. No.: 180,050

[22] Filed: Jan. 11, 1994

[51] Int. Cl.[6] ..... B41F 1/08

[52] U.S. Cl. ..... 101/288; 101/227; 400/635

[58] Field of Search ..... 101/226, 227, 288, 219; 271/33, 34; 226/93, 96; 400/621, 635; 156/384, 385, 387, 390, 436, 584, DIG. 24, DIG. 28, DIG. 33

[56] References Cited

U.S. PATENT DOCUMENTS

| | | | |
|---|---|---|---|
| 2,326,436 | 8/1943 | Caldwell . | |
| 4,073,234 | 2/1978 | Sato . | |
| 4,262,591 | 4/1981 | Cook | 101/227 |
| 4,384,525 | 5/1983 | Sato et al. . | |
| 4,650,350 | 3/1987 | Dorner | 400/120 |
| 4,707,211 | 11/1987 | Shibata | 156/384 |
| 5,026,180 | 6/1991 | Tajima et al. | 101/409 |
| 5,060,009 | 10/1991 | Milovanovich | 271/33 |
| 5,069,564 | 12/1991 | Kako et al. . | |

FOREIGN PATENT DOCUMENTS

| | | | |
|---|---|---|---|
| 5634458 | 4/1981 | Japan | 101/288 |

*Primary Examiner*—Ren Yan

*Attorney, Agent, or Firm*—Bell, Seltzer, Park & Gibson

[57] ABSTRACT

The method and apparatus for printing adhesive backed media, such as a label strip or a multi-part form, includes an endless belt which is rotatably mounted to a support frame and is advanced along an endless path of travel such that a label strip may be fed from a wound roll to the endless belt with the adhesive backed side of the label strip directly in contact with the endless belt, and indicia may be imprinted upon the opposite side of the label strip. The printing apparatus includes a platen mounted within the endless belt and a print head positioned in alignment with the platen so that the endless belt and the label strip carried by the endless belt extend between the print head and the platen so as to permit printing on the label strip. The printing apparatus may include a stripping roller mounted at the downstream end of the endless belt and having a relatively small radius to facilitate the release of the adhesive backed label strip from the endless belt.

29 Claims, 4 Drawing Sheets

METHOD AND APPARATUS FOR PRINTING ADHESIVE BACKED MEDIA

FIELD OF THE INVENTION

The present invention relates to printing devices and, more particularly, to devices for printing adhesive backed media.

BACKGROUND OF THE INVENTION

Numerous labels and forms are printed each day. The printed labels are typically attached to envelopes or other packages to indicate the source or destination of the envelope or package as well as any particular handling information of which the carrier should be aware. For example, the U.S. Postal Service, Federal Express and other delivery services prepare individual labels for each letter or package to be delivered which indicate the addresses of both the source and the recipient, a tracking number and other relevant shipping information.

In order to print the relatively large number of labels required, devices for rapidly printing large numbers of labels, typically supplied in a continuous strip which is wound in a roll, have been developed. These printing devices draw the strip of labels from the wound roll and feed the labels past the print head such that predetermined information may be imprinted upon the individual labels. The operator may thereafter remove the printed labels and apply them to the corresponding packages.

The information to be imprinted on the labels corresponds to data received by the printing device from any one of several sources, including manual entry. The information, regardless of its source, may be imprinted upon the labels by a variety of methods including serial dot matrix printing, thermal printing, laser printing, impact matrix printing, ink jet printing, impact full form printing or other electrographic printing methods.

To further facilitate the rapid printing and processing labels, labels have been specifically developed to be printed by such label printing devices. These labels, which are generally supplied in a wound roll, typically have an adhesive backing and are releasably supported a carrier web. In particular, a layer of a release agent, such as silicone, is generally disposed between the adhesive backing and the carrier web to permit removal of the labels from the carrier web. In operation, the wound roll of labels and the supporting carrier web are rotatably supported by the printing device. The label strip is drawn from the roll and sequentially fed past a print head to imprint the desired information. The carrier web is then passed about a roller which removes the labels from the carrier web so as to permit application of the imprinted labels to a product. The remaining carrier web may thereafter be wound upon a take-up reel for subsequent disposal.

The carrier web remaining once the labels have been printed and removed is not reused, but is scrap which must be thrown away. Even the disposal of the scrap carrier web is problematic, however, since the carrier web contains silicone which requires a relatively long time to degrade. Further, it is estimated that the cost of the carrier web, which is eventually discarded amounts to 20% to 30% of the original cost of the wound roll of labels, thus increasing the material cost of the labels.

Accordingly, labels have been developed which do not include a supporting carrier web. These labels have a primary substrate which is coated with a layer of adhesive on one side. Further, if these labels are formed in a strip which is to be wound in a roll, a layer of a release agent, such as silicone, is applied to a second side of the primary substrate, opposite the adhesive layer, so as to permit wound roll of labels to be unwound during printing.

Conventional label printing machines, however, are not adapted to process labels or strips of labels which are not supported by a carrier web. Correspondingly, the labels adhere to the feed mechanism, typically a number of rollers, of the printing device which draws the labels from the wound roll, feeds them toward the print head and then draws them from the print head following printing. Consequently, the printed labels may not be readily withdrawn from the printing device.

Thus, while it is desirable to print information upon labels which are provided in a strip and which are not supported by a carrier web, label printing machines which are presently available cannot properly process the labels so as to permit the labels to be printed with the desired information and then be readily withdrawn from the printing machine.

SUMMARY OF THE INVENTION

It is therefore an object of the invention to provide an improved method and apparatus for printing a strip of labels.

It is another object of the invention to provide an improved method and apparatus for printing an adhesive backed media which is not supported by a carrier web.

It is a further object of the invention to provide an improved method and apparatus for printing a strip of labels which includes an endless belt mounted so as to readily release the labels following the printing of indicia on one side thereof.

These and other objects are provided, according to the invention, by a printing apparatus which includes an endless belt rotatably mounted to a support frame which receives adhesive backed media, such as a label strip, at an upstream end, feeds the label strip past a print head and permits the label strip to be readily withdrawn from a downstream end of the endless belt following the printing of indicia on one side of the label strip. Thus, a label strip consisting of a primary substrate which is coated on one side with a layer of adhesive, but which is not supported by a carrier web may be printed by and readily withdrawn from the printing apparatus of the present invention.

The endless belt of the printing apparatus is rotatably mounted to the frame so as to define an endless path of travel which includes an upper delivery run and a lower return run. The upper delivery run defines the upstream end and the downstream end of the endless belt. The printing apparatus also includes means for advancing the endless belt along its path of travel so as to move the upper delivery run from the. upstream end to the downstream end.

Further, the printing apparatus includes a platen and a corresponding means for printing indicia on one side of the label strip. The printing means includes a print head positioned in alignment with the platen. The platen is preferably a roller mounted within the endless belt along the upper delivery run so that the upper delivery run of the endless belt extends between the print head and the platen.

The adhesive backed label strip is typically supplied in a wound roll which is rotatably supported by a holder mounted to the support frame of the printing apparatus. In operation, the label strip may be fed from the wound roll and delivered onto the upstream end of the upper delivery run of the endless belt. The label strip is presented to the endless belt such that the adhesive layer directly contacts the belt.

Advancement of the endless belt feeds the label strip between the print head and the platen so as to permit printing of indicia on the side of the label strip opposite the adhesive backing. Thereafter, the label strip may be withdrawn from the endless belt at its downstream end.

To facilitate the withdrawal of a label strip from the printing apparatus, the printing device preferably includes a stripping roller mounted within the endless belt at the downstream end of the delivery run. The stripping roller has a relatively small radius as compared to the radius of the platen. In one embodiment, the outer radius of the platen roller is at least about one-quarter ($\frac{1}{4}$) inch and the outer radius of the stripping roller is between about one-sixteenth (1/16) and one-eighth ($\frac{1}{8}$) inch.

Thus, the endless belt is sharply turned as it advances about the stripping roller. This sharp turn of the endless belt facilitates release of the label strip from the upper delivery run of the endless belt at its downstream end. Due to the sharp turn of the endless belt about the stripping roller, the endless belt preferably encircles a substantial portion of the peripheral surface of the stripping roller. Most preferably, the stripping roller is sized and positioned so that the endless belt contacts an arc of at least about 90° about its peripheral surface.

The stripping roller is preferably biased outwardly against the endless belt. The endless belt is therefore stretched taut about the stripping roller and the platen. The printing apparatus also preferably includes a back roller. The backup roller is preferably biased outwardly against the endless belt to stretch the belt taut about backup roller and the platen.

In one embodiment, the printing apparatus also preferably includes means for biasing the print head against the endless belt and the underlying platen so as to maintain printing contact between the print head and the label strip. To provide enhanced printing contact, the platen preferably has an outer peripheral layer which comprises a resilient material. Thus, the force exerted by the print head against the endless belt and the underlying platen compresses a portion of the outer resilient peripheral layer of the platen and forms a relatively flat printing support surface on the portion of the platen underlying and contacting the endless belt.

One embodiment of the endless belt of the printing apparatus comprises a substrate which is coated with a release material. In this embodiment, the endless belt has a thickness which is less than about 1/32 of an inch. In another embodiment, the endless belt comprises a silicone material which does not appreciably adhere to the adhesive layer of the label strip. Further, the width of the endless belt is preferably greater than the width of the label strip.

The printing apparatus preferably includes means for controlling the advancement of the endless belt. In particular, the endless belt is preferably only advanced once the individual labels, which have been fed between the print head and the platen, have been separated from the remainder of the label strip. The controlling means preferably includes means for detecting that the printed labels have been released from the endless belt at its downstream end and have been separated from the remainder of the label strip. The detecting means is operably connected to the advancing means such that further advancement of the endless belt is only permitted once the predetermined number of individual labels have been separated.

The printing apparatus also includes means for controlling the registry or alignment of the label strip with the print head. The alignment controlling means preferably includes means, positioned upstream of the print head, for detecting the position of individual labels. The position detecting means is operably connected to the advancing means such that the label strip and the print head are aligned.

In one embodiment, the label strip includes a plurality of longitudinally spaced apart marks on the adhesive backed side of the label strip. The marks are preferably positioned in a predetermined relationship to the individual labels. In this embodiment, the position detecting means for controlling the registry of the label strip are optical sensors adapted to sense the marks on the label strip.

Accordingly, a strip of adhesive backed labels which is not supported by a carrier web may be fed through the printing apparatus of the present invention and indicia may be printed thereon. Further, the printing apparatus of the present invention facilitates the release of the labels from the endless belt following the imprinting of the information such that the printed labels may be readily withdrawn from the printing apparatus and applied to the appropriate envelope or package.

DESCRIPTION OF THE PREFERRED EMBODIMENT

The present invention will now be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete and will fully convey the scope of the invention to those skilled in the art. Like numbers refer to like elements throughout.

Figure 1:
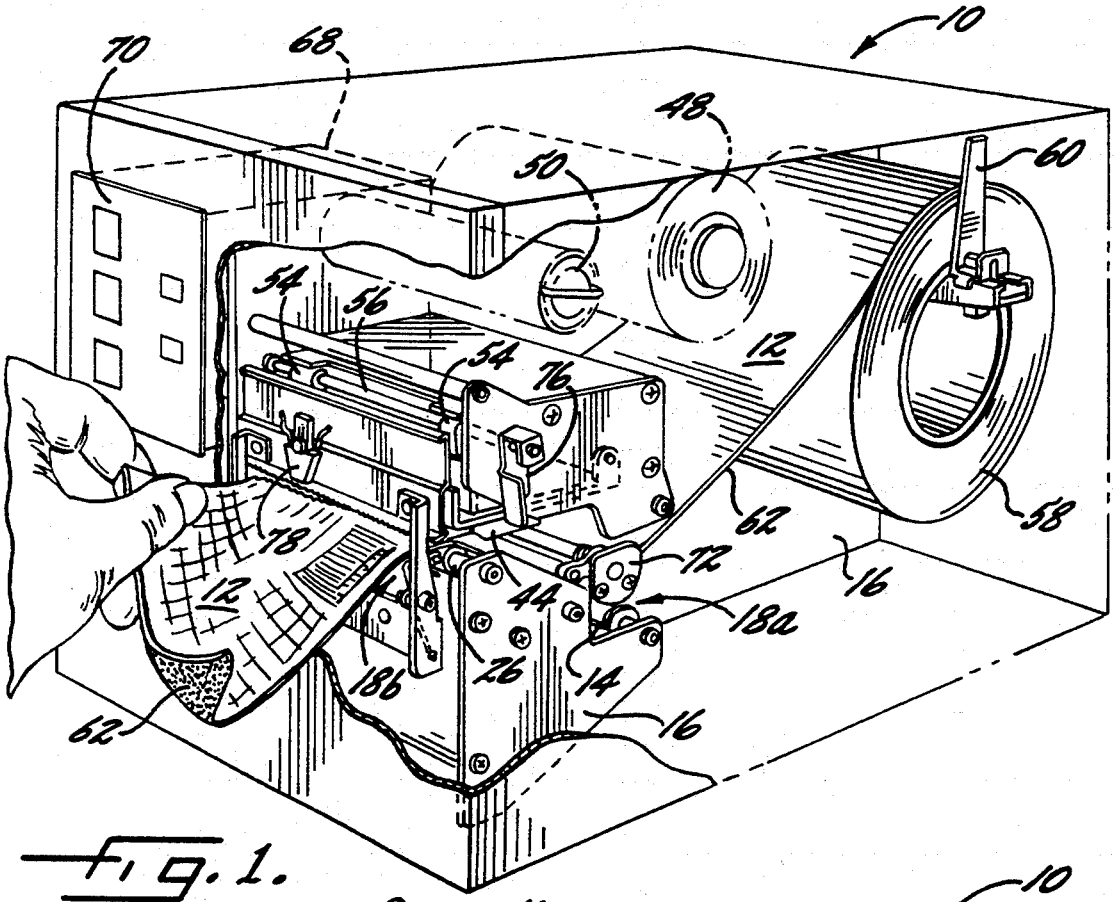
FIG. 1 is a perspective view of a printing apparatus according to the present invention which is partially cut-away to illustrate the internal components thereof.

Referring now to FIG. 1, a printing apparatus 10 according to one embodiment of the present invention is illustrated. The printing apparatus 10 is adapted to print indicia on one side of a strip of labels 12, each of which has an adhesive backing on one side. The printing apparatus 10 of the present invention includes an endless belt 14 rotatably mounted to a frame 16 so as to define an endless path of travel. The endless path of travel includes an upper delivery run 18 and a lower return run 20. The upper delivery run 18 defines, in turn, an upstream end 18*a* and a downstream end 18*b*.

Figure 3:
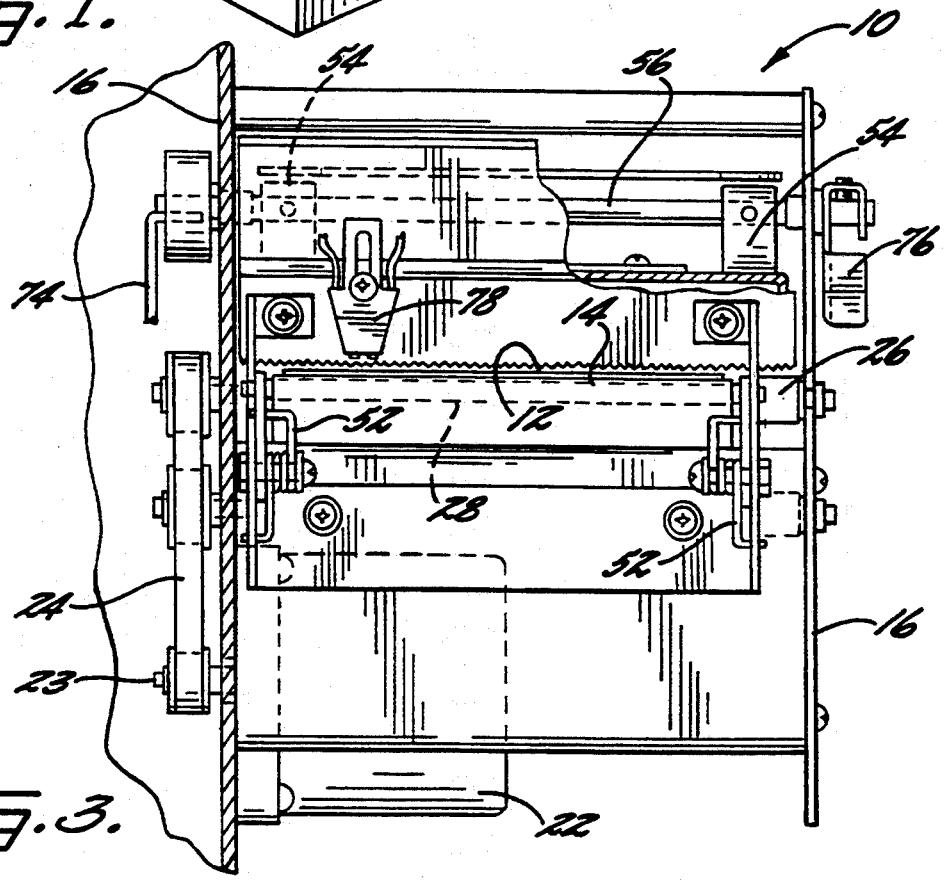
FIG. 3 is a front cross-sectional view of the printing apparatus of the present invention taken along line 3—3 of FIG. 2.
Figure 2:
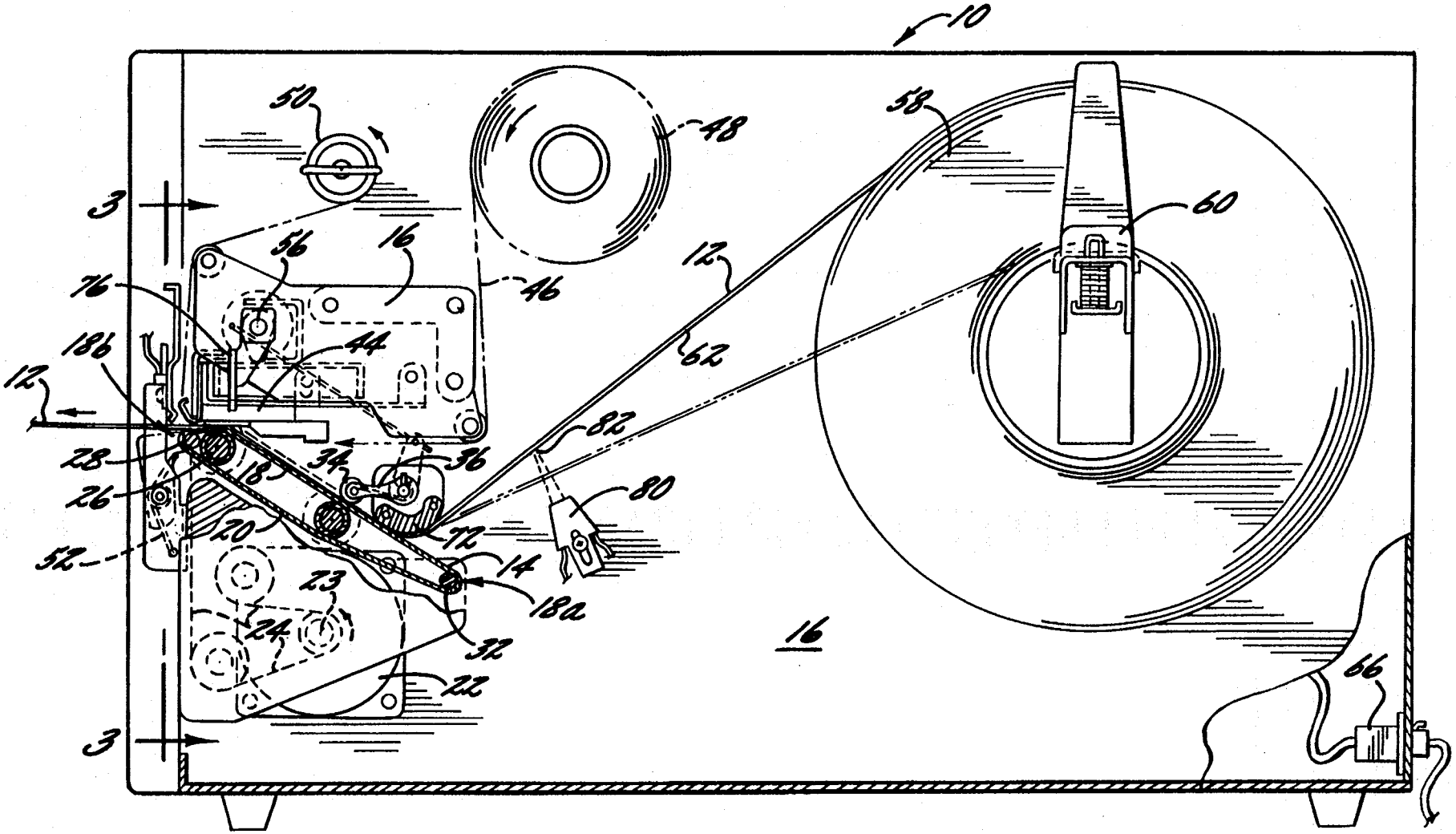
FIG. 2 is a lateral cross-sectional view of the printing apparatus illustrated in FIG. 1.

The printing apparatus 10 also includes means for advancing the endless belt 14 along the endless path of travel in a direction such that the upper delivery run 18 moves from the upstream end 18*a* to the downstream end 18*b*. As illustrated in FIGS. 2 and 3, the advancing means may include a drive motor 22 operably connected to the endless belt 14. In the embodiment illustrated, the rotational energy supplied by the drive motor 22 is coupled, via a drive belt to the endless belt 14 so as to advance the belt about its endless path of travel.

Figure 4:
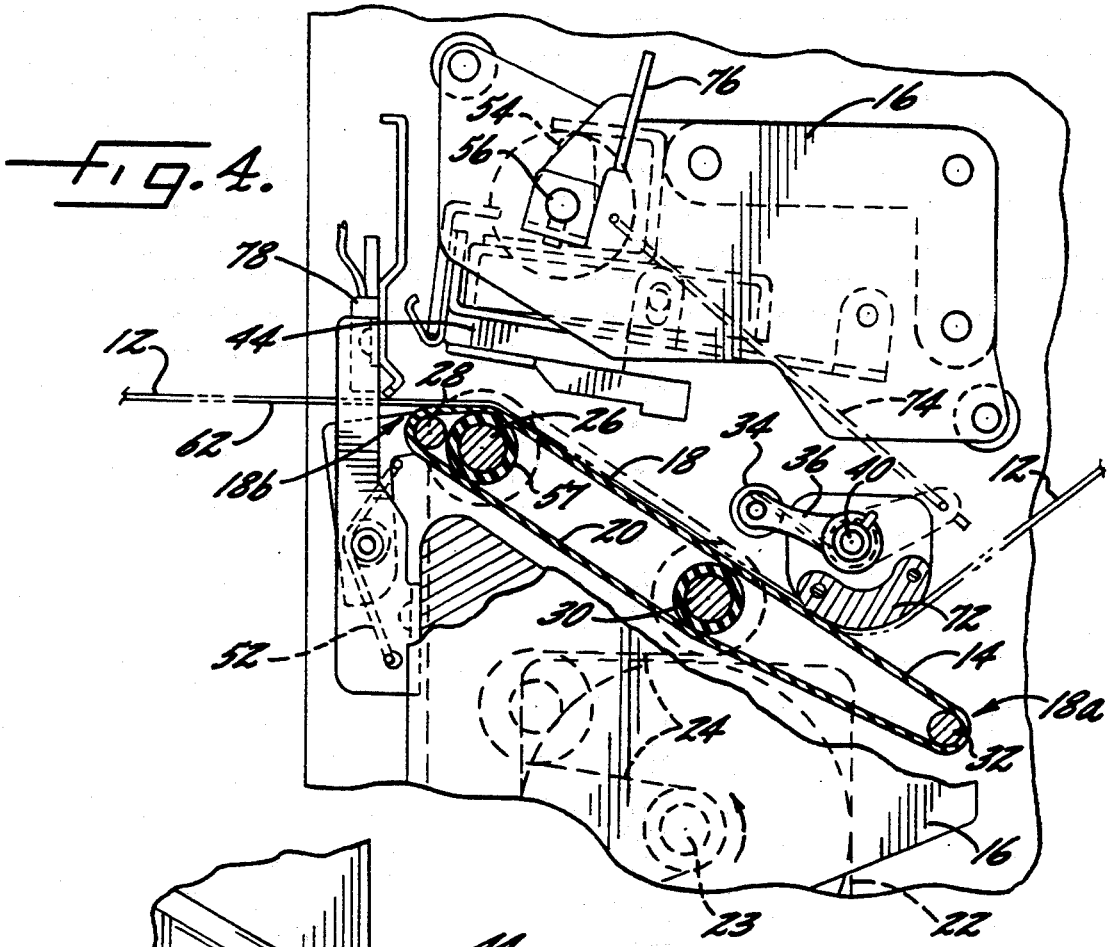
FIG. 4 is a lateral cross-sectional view of a portion of the printing apparatus of the present invention illustrating the positioning of the print head in a raised or inoperative position.

The endless belt 14 is preferably mounted about a plurality of rollers. As is best illustrated in FIGS. 2 and 4, a platen 26 is mounted within the endless belt 14. Although the platen 26 is illustrated as a roller, the platen may also be platform mounted within the endless belt 14. In addition, a stripping roller 28, drive roller 30 and platform roller 32 are also preferably mounted within the endless belt 14. As will be subsequently discussed in greater detail, the platform 32 facilitates the loading of the label strip 12 in the printing apparatus 10 and the stripping roller 28 facilitates the removal of the printed labels from the printing apparatus 10.

The drive roller 30 is operably connected to the advancing means, such as the drive motor 22, so as to advance the belt 14. In particular, the drive belt 24 of the embodiment illustrated in FIGS. 2 and 4 is wrapped about the drive shaft 23 of the drive motor 22 as well as the drive roller 30. Thus, the rotation of the drive shaft 23 is imparted, via the drive belt 24, to rotate the drive roller 30 and, in turn, to advance the endless belt 14 about its endless path of travel. As is also illustrated, the drive belt 24 may also wrap about and rotate the platen roller 26 which also advances the endless belt 14.

The printing apparatus 10 may also include a backup roller 34 which contacts the endless belt 14 and is aligned from the drive roller 30 on the opposite side of the endless belt 14. The backup roller 34 is preferably biased against the endless belt 14 and the underlying drive roller 30 to improve the contact of the drive roller 30 with the belt such that substantially all rotation of the drive roller 30 imparted by the circulating drive belt 24 is imparted to advance the endless belt 14.

Figure 6:
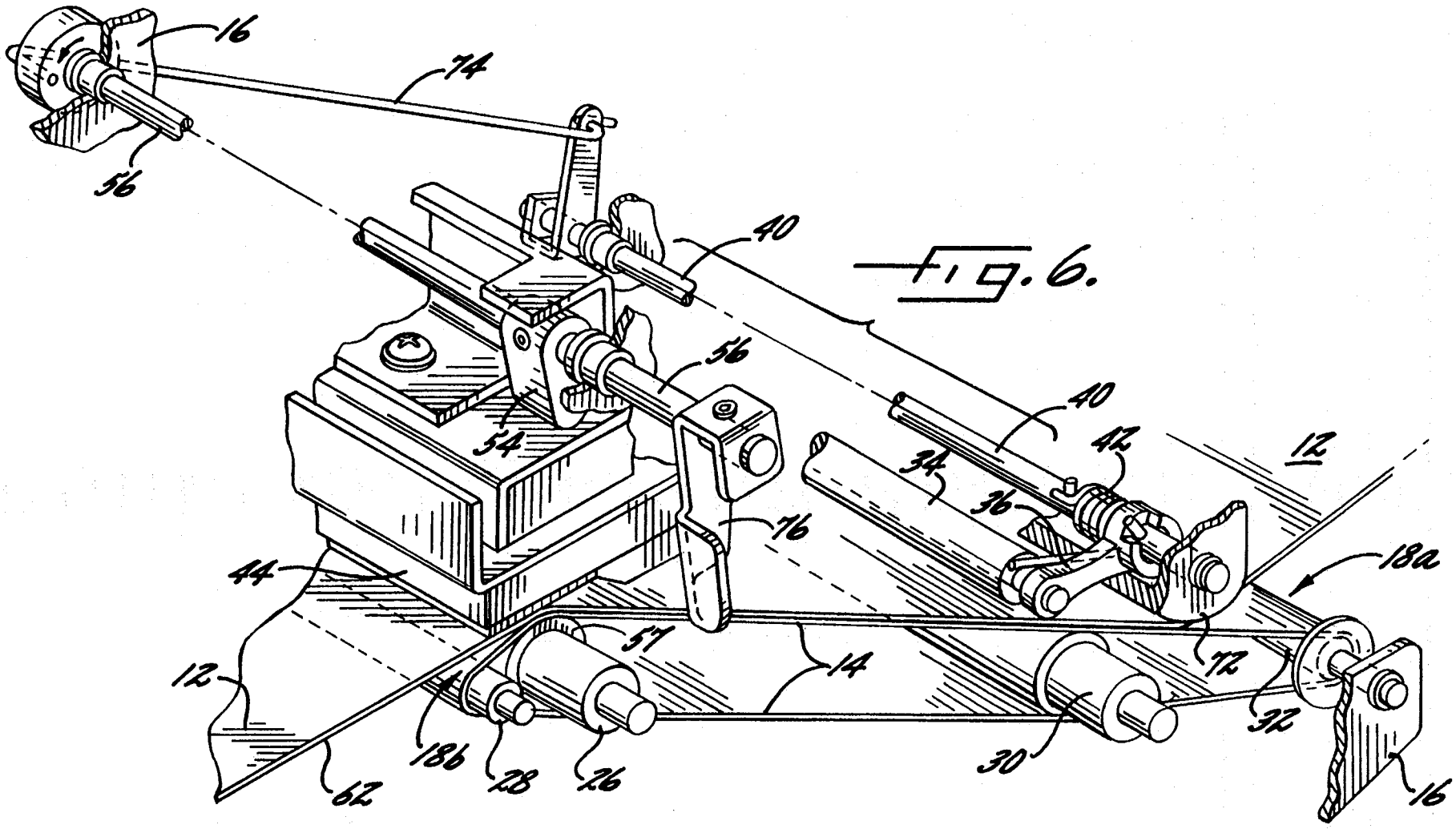
FIG. 6 is a perspective view of a portion of the printing apparatus of the present invention illustrating the endless belt and its associated rollers and print head.

As illustrated in FIG. 6, the backup roller 34 is typically carried by first and second arms which extend from a rotatable rod 40 mounted on the support frame 16. The rotatable rod 40 carries a spring 42 which urges the backup roller 34 downward against the endless belt 14. A first end of the backup roller bias spring 42 is held in a fixed position while the second end urges the first arm 36, and thus the backup roller 34 against the endless belt 14 and the underlying drive roller 30.

The printing apparatus 10 of the present invention also includes means for printing indicia on one side of the label strip 12. The printing means includes a print head 44 positioned in alignment with the platen 26. Thus, the upper delivery run 18 of the endless belt 14, as well as the label strip 12 carried by the upper delivery run 18, extends between the print head 44 and the platen 26. The print head 44 may be adapted to print the labels according to any of the known methods of printing including serial dot matrix, direct thermal, thermal transfer, laser, line matrix, ink jet or impact full form printing as well as other electrographic printing methods. In the embodiment illustrated, the print head 44 is adapted to provide direct thermal or thermal transfer printing as is known to those skilled in the art. Accordingly, a ribbon 46 coated with an inked material extends between the print head 44 and the label strip 12 such that selective heating of ribbon 46 by the print head 44 will imprint the desired indicia on the label 12. As illustrated, the ribbon 46 is typically drawn from a ribbon supply reel 48, is passed between the print head 44 and the underlying label 12 and is collected by a ribbon rewind reel 50.

The printing apparatus 10 also preferably includes a stripping roller 28 mounted within the endless belt 14 at the downstream end 18*b* of the upper delivery run 18. The stripping roller 28 preferably has a relatively small radius as compared to the radius of the platen roller 26. For example, for a printing apparatus adapted to perform direct thermal or thermal transfer printing, the platen roller 26 preferably has an outer radius of at least about one-quarter ($\frac{1}{4}$) inch while the stripping roller 28 has an outer radius between about one-sixteenth (1/16) inch to one-eighth ($\frac{1}{8}$) inch. For other embodiments of the printing apparatus such as a printing apparatus adapted to perform impact printing, the sizes of stripping roller 28 and the platen 26 will generally be larger. However, the stripping roller 28 will still preferably have a relatively small radius as compared to the radius of the platen roller 26.

The relatively small radius of the stripping roller 28 causes the endless belt 14 to be sharply turned as it advances about the stripping roller 28. The sharp turning of the endless belt 14 releases the label strip 12 from the upper delivery run 18 at the downstream end 18*b* thereof. As illustrated, the endless belt 14 encircles a substantial portion of the peripheral surface of the stripping roller 28 which further facilitates the release of the label strip 12 from the endless belt 14. In particular, the stripping roller 28 is sized and positioned so that the endless belt 14 contacts an arc of at least about 90° about preferably 120° the peripheral surface of the stripping roller 28. Most preferably, the endless belt 14 contacts an arc of at least about 120° about the peripheral surface of the stripping roller.

Figure 5:
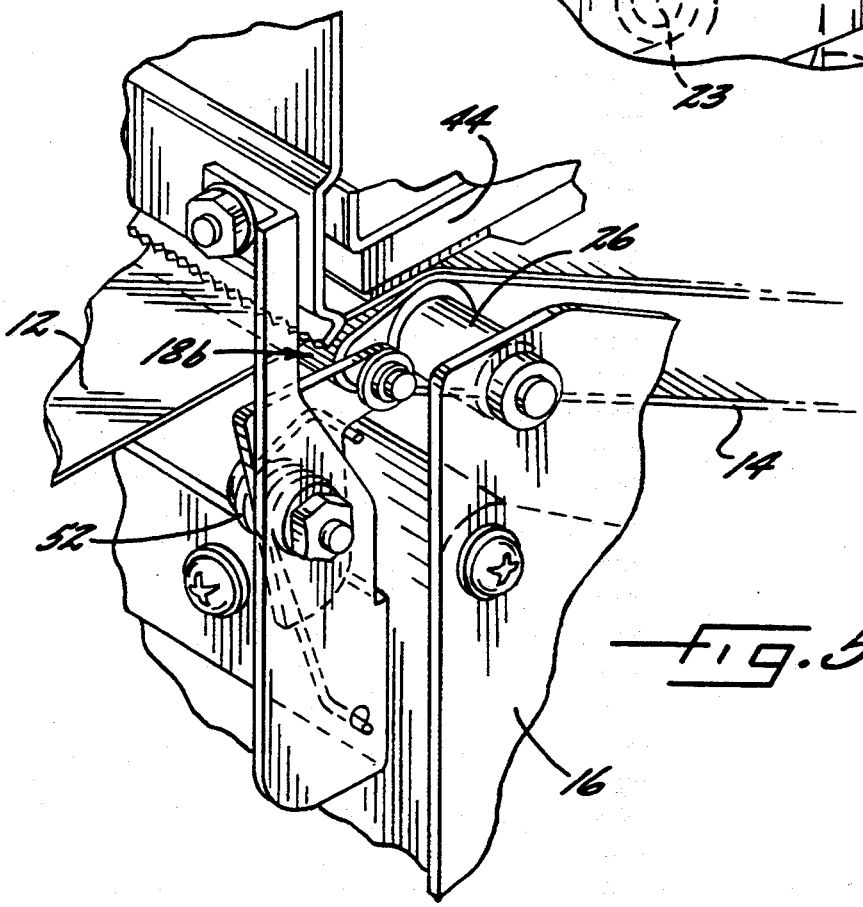
FIG. 5 is a perspective view of a portion of the printing apparatus of the present invention illustrating the platen and stripping rollers as well as the biasing of the stripping roller outwardly against the endless belt.

Further, the printing apparatus 10 preferably includes means for biasing the stripping roller 28 outwardly against the endless belt 14. Thus, the endless belt 14 is stretched taut about the stripping roller 28 and platen 26. As illustrated in FIGS. 4 and 5, the means for outwardly biasing the stripping roller 28 includes a spring 52 having a first end held in a fixed position relative to the support frame 16 and the endless belt 14 and a second end which engages and urges the stripping roller 28 outwardly against the endless belt 14. By varying the strength of the spring 52, the amount of outward bias supplied by the stripping roller 28 to the endless belt 14 may be adjusted. Alternatively, the platform roller 32 may be biased outwardly against the endless belt 14 in a similar manner to that described above with respect to the stripping roller 28 to stretch the endless belt 14 taut.

For a printing apparatus adapted to perform direct thermal or thermal transfer printing, the printing apparatus 10 also preferably includes means for biasing the print head 44 against the endless belt 14 and the underlying platen 26. The means for biasing the print head 44 maintains printing contact between the print head 44 and the label strip 12 which is advanced between the print head 44 and the platen 26. In one embodiment, the print head 44 may be held in two positions, namely, a first or operative position and a second or raised position. The first or operative position of the print head 44 is illustrated in FIG. 2 in which printing contact is maintained between the print head 44 and the label strip 12. The second or raised position is shown in FIG. 4.

The means for biasing the print head 44 against the endless belt 14 preferably include a pair of cams 54 which contacts an upper surface of the print head 44. The cams 54 are preferably mounted upon a rod 56 which, in turn, is rotatably mounted to the support frame 16. The rod 56 may be rotated between first and second positions. When rotated to a first position as illustrated in FIG. 6, the cam 54 exerts a downward force on the print head 44 so as to bias the print head 44 against the endless belt 14 and the underlying platen 26. In contrast, when rotated to a second position as illustrated in FIG. 4, an upward or lifting force is applied by the cam 54 to the print head 44 so as to lift the print head from printing contact with the label strip 12.

In one embodiment, the platen 26 includes an outer peripheral layer 57 of resilient material to further enhance the print quality. Thus, the force exerted by the print head 44 against the endless belt 14 and the underlying platen 26 compresses a portion of the outer layer 57 of the platen 26 to form a relatively flat printing surface on the portion of the platen 26 contacting the endless belt 14.

The printing apparatus 10 of the present invention is particularly adapted from printing indicia on labels. As illustrated in FIGS. 1 and 2, the labels 12 may be supplied in a wound roll 58. The wound roll 58 is preferably rotatably supported by a holder 60 which, in turn, is mounted to the support frame 16 or housing of the printing apparatus 10. The adhesive backed label strip 12 is thereafter advanced via a feed mechanism past the print head 44 for printing the predetermined indicia thereon. As illustrated, the printed labels 12 may be withdrawn from the printing apparatus 10 and separated from adjacent labels by the operator.

As shown in FIG. 1, the label strip 12 typically consists of a primary substrate which has an adhesive backing 62 on one side for attachment to an envelope or package once the predetermined indicia has been imprinted on the side of the label opposite the adhesive backing. Further, the label strip 12 is characterized in that, unlike conventional label strips, the label strips 12 which the printing apparatus 10 in the present invention is particularly adapted to process are not mounted upon a carrier web. Instead, the side of the label strip 12 opposite the adhesive backing is coated with a release agent, such as silicone. Accordingly, the adhesive will not adhere adjacent label strips together and the label strip 12 may be drawn from the wound roll 58.

In addition to printing label strips, the printing apparatus 10 of the present invention may also print other forms of media, including two-ply and multi-part forms. These forms may also be supplied in a wound roll and may be fed through the printing apparatus 10 such that indicia is imprinted thereon.

The endless belt 14 preferably includes a substrate which is coated with a release material. Since the adhesive backed labels are placed upon and transported by the endless belt 14, the endless belt 14 does not significantly adhere to the adhesive backing 62 of the labels. Thus, the coating of the endless belt 14 may be formed of silicone which does not significantly adhere to the adhesive backing 62 of the labels. Alternatively, the endless belt 14 may be formed of a fabric, such as polyester, which is coated with a release agent, such as silicone.

The endless belt 14 is preferably relatively thin and, more preferably, has a thickness of less than about 1/32 of an inch. In one embodiment, the endless belt 14 has width greater than the width of the labels 12. In an alternative embodiment, the endless belt 14 may be comprised of a plurality of parallel belts which are mounted upon the rollers such that the lateral portions of adjacent belts abut. In this embodiment, the cumulative width of the parallel belts is preferably greater than the width of the labels 12.

The information to be imprinted via the print head 44 may be provided to the printing apparatus 10 of the present invention according to any of the known methods. For example, the information to be imprinted may be provided via a data interface 66 from a source, such as a computer system, to a system controller 68. The system controller 68 is operably connected to the print head 44 and transmits signals thereto indicative of the particular indicia to be imprinted and the order and timing of the printing. Alternatively, the information or indicia to be imprinted upon the labels may be entered by the operator via a keypad 70 which is operably connected to the print head 44 for providing the control and timing signals necessary to print the desired information on the labels. Still further, other methods of providing the printing apparatus be with the predetermined information or indicia to be imprinted on the labels are known to those skilled in the art and may be utilized.

In order to load the label strip 12 in the printing apparatus be, the label strip 12 is delivered, such as from the wound roll 58 as illustrated in FIGS. 1 and 2, to the upstream end 18*a* of the upper delivery run 18 of the endless belt 14. In particular, the label strip 12 is preferably delivered to an upwardly exposed portion of the upper run of the endless belt 14 between the platform roller 32 and the drive roller 30. Delivery of the label strip 12 is facilitated by guide means, such as the guide 72 illustrated in FIGS. 2 and 6. The guide 72 is carried by the rotatable rod 40 and is semi-circular in transverse cross-section to assist in loading the label strip 12. As shown, the label strip 12 is fed between the guide 72 and the endless belt 14.

To feed the label strip 12 between the endless belt 14 and both the backup roller 34 and print head 44, the backup roller 34 and print head 44 must be raised from the surface of the endless belt 14 as shown in FIG. 4. To facilitate the raising of both the print head 44 and the backup roller 34, the rotatable rod 40 which carries the backup roller 34 and the rod 56 which carries the print head 44 are connected, such as via connecting rod 74, such that both the backup roller 34 and the print head 44 are raised and lowered simultaneously. Accordingly, the operator may raise both the backup roller 34 and the print head 44 by rotating rod 56 with handle 76 so as to permit loading of the label strip 12 in the printing apparatus 10.

Once the label strip 12 has been fed between the backup roller 34 and the endless belt 14 and the backup roller 34 has been lowered into contact with the label strip 12, advancement of the endless belt 14, due to rotation of the drive roller 30 by the drive motor 22, will also advance the label strip 12 along the endless belt 14 to its downstream end 18*b*. Thus, the loading of the label strip 12 may be completed.

In one embodiment, the printing apparatus 10 includes means for controlling the advancement of the endless belt 14 and the feeding of the label strip 12 between the print head 44 and the platen 26. Thus, the label strip 12 is only advanced once the individual labels which have already been fed between the print head 44 and the platen 26 have been separated from the remainder of the label strip. The controlling means therefore prevents a large number of printed labels from accumulating.

In particular, the means for controlling the advancement of the endless belt 14 includes means for detecting that the individual labels fed between the print head 44 and the platen 26 and released from the endless belt 14 at the downstream end 18*b* thereof have been separated from the remainder of the label strip 12. The detecting means may include any detecting means known to those skilled in the art, including an optical sensor 78 such as that illustrated in FIGS. 1 and 3. The optical sensor 78 is operably connected to the advancing means such that the endless belt 14 is permitted to be advanced once the individual labels have been separated from the remainder of the label strip 12.

The printing apparatus 10 may also include means for controlling the registry or alignment of the label strip with the print head. Thus, for label strips which have been partially preprinted such as with the name of the delivery service, the desired indicia may be printed in the appropriate position relative to the preprinted material on the individual labels. The alignment controlling means also preferably includes means for detecting the position of the individual labels. The position detecting means is positioned upstream of the print head 44 and is operably connected to the means for advancing endless belt 14 such that the label strip 12 and the print head 44 may be aligned. The position detecting means may also be any type of detecting means known to those skilled in the art, including an optical sensor 80 as illustrated in FIG. 2.

The label strip 12, for use in conjunction with optical detectors, such as those illustrated in FIG. 2, includes a plurality of longitudinally spaced apart marks 82 on the adhesive backed side of the label strip 12. A mark 82 is preferably positioned in a predetermined relationship with the individual labels. For example, a mark 82 may be located between adjacent labels. Optical sensor 80 is adapted to sense the marks 82 on the label strip 12 such that the label strip 12 and the print head 44 are aligned.

As illustrated in FIG. 2, the optical sensors 78 and 80 may be position downstream of and upstream of the endless belt 14, respectively. However, the optical sensors 78 and 80 may be mounted in different locations within the printing apparatus 10 or only a single sensor may be employed without departing from the spirit and scope of the invention. For example, one or both optical sensors may be positioned within the endless belt 14. In this embodiment, the endless belt 14 is preferably translucent or transparent to permit detection of the marks 82 therethrough.

As described herein, an adhesive backed label strip 12 may be advanced along in an endless belt 14 such that indicia may be imprinted on one side of the label strip 12 and the label strip 12 may be withdrawn from the endless belt 14 at the downstream end 18*b* thereof. Thus, the printing apparatus 10 of the present invention permits printing of label strips which are not mounted upon a carrier web so as to decrease the media cost of the labels. Further, the printing apparatus 10 of the present invention facilitates ready removable of the label strip 12 from the downstream end 18*b* of the endless belt 14.

In the drawings and the specification, there has been set forth a preferred embodiment of the invention, although specific terms are employed, the terms are used in a generic and descriptive sense only and not for purposes of limitation, the scope of the invention being set forth in the following claims.

That which is claimed is:

1. An apparatus for printing a linerless label strip backed with a tacky adhesive which is supplied in a wound roll, and comprising:

a support frame, a holder mounted to said frame for rotatably supporting the wound roll of the label strip, an endless belt, means rotatably mounting said endless belt to said frame so as to define an endless path of travel which includes an upper delivery run and a lower return run, with said upper delivery run defining an upstream end and a downstream end, a platen mounted within said endless belt along said upper delivery run, means for advancing said endless belt along said endless path of travel in a direction so that said upper delivery run moves from said upstream end to said downstream end, means for printing indicia on one side of said label strip and including a print head positioned in alignment with said platen and so that said upper delivery run of said endless belt extends between said print head and said platen, and a stripping roller rotatably mounted within said endless belt at said downstream end of said upper delivery run such that said endless belt encircles a substantial portion of the peripheral surface of said stripping roller and such that said endless belt is sharply turned as it advances about said stripping roller so as to thereby facilitate the release of the label strip from said upper delivery run at said downstream end thereof, the label strip being fed from said wound roll and delivered onto said upstream end of said upper delivery run of said endless belt such that the tacky adhesive backing of the label strip directly contacts said endless belt, and the advance of said endless belt feeds the label strip between said print head and said platen so as to permit printing thereon, and the label strip is withdrawn from the endless belt at said downstream end of said endless belt.

2. The printing apparatus as defined in claim 1 wherein said platen includes a roller and said stripping roller has a relatively small radius as compared to the radius of said platen roller so as to cause the endless belt to be sharply turned as it advances about the stripping roller, and so as to thereby facilitate the release of the label strip from said upper delivery run at said downstream end thereof.

3. The printing apparatus as defined in claim 2 wherein said stripping roller is sized and positioned so that said endless belt contacts an arc of at least about 90° about the peripheral surface of said stripping roller.

4. The printing apparatus as defined in claim 2 wherein said platen roller has an outer peripheral layer which comprises a resilient material and has an outer radius of at least about ¼ inch, and said stripping roller has a radius of between about 1/16 inch and ⅛ inch.

5. The printing apparatus as defined in claim 4 wherein said endless belt comprises a substrate which is coated with a release material, and said belt has a thickness which is less than about 1/32 inch.

6. The printing apparatus as defined in claim 1 further comprising means for biasing said stripping roller outwardly against said endless belt so that said endless belt is stretched taut about said stripping roller and said platen.

7. The printing apparatus as defined in claim 1 further comprising:

a platform roller mounted within said endless belt at said upstream end of said upper delivery run; and means for biasing said platform roller outwardly against said endless belt so that said belt is stretched taut about said platform roller and said platen.

8. The printing apparatus as defined in claim 1 wherein the adhesive backed label strip is comprised of a plurality of individual labels, the printing apparatus further comprising means for controlling the advancement of said endless belt and the feeding of said label strip between said print head and said platen so that said label strip is only advanced once the individual labels which have been fed between said print head and said platen have been separated from the remainder of the label strip.

9. The printing apparatus as defined in claim 8 wherein said controlling means comprises means for detecting that the individual labels fed between said print head and said platen and released from said endless belt at said downstream end of said endless belt have been separated from the remainder of said label strip, said detecting means being operably connected to said means for advancing said endless belt such that further advancement of said endless belt is permitted once the individual labels have been separated.

10. The printing apparatus as defined in claim 1 further comprising means for controlling the alignment of the label strip with the print head.

11. The printing apparatus as defined in claim 10 wherein said alignment controlling means comprises means, positioned upstream of said print head, for detecting the position of the individual labels, said position detecting means being operably connected to said means for advancing said endless belt such that the label strip and said print head are aligned.

12. The printing apparatus as defined in claim 11 wherein said adhesive backed side of said label strip has a plurality of longitudinally spaced apart marks, and wherein said position detecting means comprises an optical sensor adapted to sense the longitudinally spaced apart marks on said label strip such that the predetermined number of individual labels and said print head are aligned.

13. A printing apparatus comprising:

a wound roll of a label strip, said label strip comprising a primary substrate, and a layer of tacky adhesive on one side of said primary substrate, and being characterized by the absence of a carrier web, a support frame, a holder mounted to said frame for rotatably supporting the wound roll of the label strip, an endless belt, means rotatably mounting said endless belt to said frame so as to define an endless path of travel which includes an upper delivery run and a lower return run, with said upper delivery run defining an upstream end and a downstream end, a platen mounted within said endless belt along said upper delivery run, means for advancing said endless belt along said endless path of travel in a direction so that said upper delivery run moves from said upstream end to said downstream end, means for printing indicia on the side of the primary substrate opposite the adhesive layer and including a print head positioned in alignment with said platen and so that said upper delivery run of said endless belt extends between said print head and said platen, and a stripping roller rotatably mounted within said endless belt at said downstream end of said upper delivery run such that said endless belt encircles a substantial portion of the peripheral surface of said stripping roller and such that said endless belt is sharply turned as it advances about said stripping roller so as to thereby facilitate the release of the label strip from said upper delivery run at said downstream end thereof, the label strip being fed from said wound roll and delivered onto said upstream end of said upper run of said endless belt, with said layer of adhesive of said label strip directly contacting said endless belt, and the advance of said endless belt feeds the label strip between said print head and said platen so as to permit printing thereon, and the label strip is withdrawn from the endless belt at said downstream end of said endless belt.

14. The printing apparatus as defined in claim 13 wherein said platen includes a roller and said stripping roller has a relatively small radius as compared to the radius of said platen roller so as to cause the endless belt to be sharply turned as it advances about the stripping roller, and so as to thereby facilitate the release of the label strip from said upper delivery run at said downstream end thereof.

15. The printing apparatus as defined in claim 13 further comprising means for biasing said stripping roller outwardly against said endless belt so that said endless belt is stretched taut about said stripping roller and said platen.

16. The printing apparatus as defined in claim 13 further comprising:

a platform roller mounted within said endless belt at said upstream end of said upper delivery run; and means for biasing said platform roller outwardly against said endless belt so that said belt is stretched taut about said platform roller and said platen.

17. The printing apparatus as defined in claim 13 wherein said endless belt comprises a silicone material which does not appreciably adhere to said layer of adhesive of said label strip.

18. The printing apparatus as defined in claim 17 wherein said label strip further comprises a release layer on the side of said primary substrate opposite said layer of adhesive which does not appreciably adhere to said layer of adhesive so as to facilitate the unwinding of said label strip from said wound roll during operation of said apparatus.

19. The printing apparatus as defined in claim 13 wherein said endless belt has a width which is greater than the width of said label strip.

20. The printing apparatus as defined in claim 13 further comprising means for biasing said print head against said endless belt and said underlying platen so as to maintain printing contact between said print head and said label strip fed between said print head and said platen.

21. The printing apparatus as defined in claim 20 wherein said platen comprises an outer peripheral layer of resilient material such that the force exerted by said print head against said endless belt and said underlying platen compresses a portion of the outer layer of said platen and forms a relatively flat printing support surface on the portion of said platen contacting said endless belt.

22. A method for printing label strip comprising the steps of:

providing a wound roll of a linerless label strip, the label strip being backed with a tacky adhesive;

providing a printing apparatus having an endless belt defining an endless path of travel which includes an upper delivery run defining an upstream end and a downstream end, the printing apparatus also having a print head and a platen mounted within the endless belt in an aligned relationship with the print head such that the endless belt extends therebetween, the print apparatus further having a stripping roller of relatively small radius mounted within the endless belt at the downstream end of the Upper delivery run;

drawing the label strip from the wound roll to the upper delivery run of the endless belt such that the tacky adhesive backing of the label strip directly contacts the endless belt;

advancing the endless belt such that the upper delivery run of the endless belt moves from the upstream end to the downstream end and such that the label strip is fed between the print head and the aligned platen;

actuating the print head so as to print indicia on the side of the label strip opposite the adhesive backing; and turning the downstream end of the endless belt sharply about the stripping roller so as to release the label strip from the upper delivery run of the endless belt at the downstream end thereof such that the label strip can be withdrawn from the endless belt the downstream end.

23. The method as defined in claim 22 further comprising the step of biasing the stripping roller outwardly against said endless belt so that said endless belt is stretched taut about said stripping roller and said platen.

24. The method as defined in claim 22 further comprising the step of biasing a platform roller outwardly against the upstream end of said endless belt so that said endless belt is stretched taut about said stripping roller, said platform roller and said platen.

25. The method as defined in claim 22 further comprising the step of biasing said print head against said endless belt and said underlying platen so as to maintain printing contact between said print head and said label strip fed between said print head and said platen.

26. The method as defined in claim 22 further comprising the steps of:

halting the endless belt once an individual label has been fed between the print head and the platen and has been released from the endless belt at the downstream end of the endless belt;

detecting that the individual label fed between the print head and the platen and released from the endless belt at said downstream end of the endless belt has been separated from the remainder of the label strip; and causing a further advancement of said endless belt once the individual label has been separated.

27. The method as defined in claim 22 further comprising the step of aligning the label strip with the print head.

28. The method as defined in claim 27 wherein the aligning step further comprises the steps of:

detecting the position of the individual labels upstream of the print head and the platen; and controlling the advancement of the endless belt so that the individual labels and the print head are aligned.

29. The method as defined in claim 28 wherein the adhesive backed side of said label strip has a plurality of longitudinally spaced apart marks, and wherein said detecting step comprises the step of sensing the marks on the label strip.

* * * * *